US008622569B1

(12) United States Patent
Crookham et al.

(10) Patent No.: US 8,622,569 B1
(45) Date of Patent: Jan. 7, 2014

(54) METHOD, SYSTEM AND APPARATUS FOR CONTROLLING LIGHT DISTRIBUTION USING SWIVEL-MOUNT LED LIGHT SOURCES

(75) Inventors: Joe P. Crookham, Oskaloosa, IA (US); Thomas A. Stone, University Park, IA (US); Matthew D. Drost, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 228 days.

(21) Appl. No.: 12/838,052

(22) Filed: Jul. 16, 2010

Related U.S. Application Data

(60) Provisional application No. 61/226,571, filed on Jul. 17, 2009, provisional application No. 61/320,888, filed on Apr. 5, 2010.

(51) Int. Cl.
*F21S 8/00* (2006.01)

(52) U.S. Cl.
USPC ..... 362/145; 362/287; 362/249.02; 362/220; 362/232; 362/239

(58) Field of Classification Search
USPC ..... 362/287, 145, 293, 249.02, 220, 232, 362/239, 249.03, 249.07
See application file for complete search history.

(56) References Cited

U.S. PATENT DOCUMENTS

| | | | |
|---|---|---|---|
| 3,265,883 | A | 8/1966 | Tolbert |
| 4,450,507 | A | 5/1984 | Gordin |
| 5,092,552 | A | 3/1992 | Dayton et al. |
| 5,253,336 | A | 10/1993 | Yamada |
| 5,906,425 | A | 5/1999 | Gordin et al. |
| 6,082,878 | A | 7/2000 | Doubek et al. |

(Continued)

FOREIGN PATENT DOCUMENTS

| | | |
|---|---|---|
| CA | 2727258 | 12/2009 |
| CN | 101220928 A | 7/2008 |

(Continued)

OTHER PUBLICATIONS

"6.7 Bessel Functions of Fractional Order, Airy Functions, Spherical Bessel Functions", Sample page from Numberical Recipes in Fortran &&: The Art of Scientific Computing (ISBN 0-521-43064-X), pp. 234-245, Copyright 1986-1992 (12 pages).

(Continued)

*Primary Examiner* — Evan Dzierzynski
(74) *Attorney, Agent, or Firm* — McKee, Voorhees & Sease, P.L.C.

(57) ABSTRACT

An apparatus, method, or system of lighting units comprising a plurality of individually positionable lighting elements, such as one or more LEDs, each element optionally having an associated optic. In embodiments of the present invention, one or more optics are developed using optimization techniques that allow for lighting different target areas in an effective manner by rotating or otherwise positioning the reflectors, refractive lenses, TIR lenses, or other lens types to create a composite beam. The apparatus, method, or system of lighting herein makes it possible to widely vary the types of beams from an available fixture using a small number of inventoried optics and fixtures. In some cases, by using a combination of individual beam patterns, a small set of individual optics would be sufficient to create a majority of the typical and specialized composite beams needed to meet the needs of most lighting projects and target areas.

17 Claims, 17 Drawing Sheets

(56) References Cited

U.S. PATENT DOCUMENTS

| | | | | |
|---|---|---|---|---|
| 6,250,774 | B1 | 6/2001 | Begemann et al. | |
| 6,402,337 | B1 | 6/2002 | Le Vasseur et al. | |
| 6,543,911 | B1 | 4/2003 | Rizkin et al. | |
| 6,655,823 | B2 | 12/2003 | Change | |
| 6,679,621 | B2 | 1/2004 | West et al. | |
| 6,814,470 | B2 | 11/2004 | Rizkin et al. | |
| 6,899,443 | B2 | 5/2005 | Rizkin et al. | |
| 6,948,838 | B2 | 9/2005 | Kunstler | |
| 6,951,418 | B2 | 10/2005 | Rizkin et al. | |
| 6,953,264 | B2 | 10/2005 | Ter-Hovhannisian | |
| 7,004,603 | B2 | 2/2006 | Knight | |
| 7,012,604 | B1 | 3/2006 | Christie et al. | |
| 7,093,961 | B2 | 8/2006 | Bentley et al. | |
| 7,229,194 | B2 | 6/2007 | Liu et al. | |
| 7,385,360 | B2 | 6/2008 | Dluzniak | |
| 7,429,757 | B2 | 9/2008 | Oyama et al. | |
| 7,452,108 | B2 | 11/2008 | Gordin et al. | |
| 7,461,948 | B2 | 12/2008 | van Voorst Vader et al. | |
| 7,495,817 | B2 | 2/2009 | Hunt | |
| 7,503,669 | B2 | 3/2009 | Rizkin et al. | |
| 7,540,629 | B2 | 6/2009 | Steinberg | |
| 7,543,941 | B2 | 6/2009 | Holder et al. | |
| 7,548,376 | B2 | 6/2009 | Kim et al. | |
| 7,566,147 | B2 | 7/2009 | Wilcox et al. | |
| 7,588,345 | B1 | 9/2009 | Davis et al. | |
| 7,618,163 | B2 | 11/2009 | Wilcox | |
| 7,625,102 | B2 | 12/2009 | Koike | |
| 7,625,104 | B2 | 12/2009 | Zhang et al. | |
| 7,637,630 | B2 | 12/2009 | Wilcox et al. | |
| 7,641,379 | B2 | 1/2010 | Gisler | |
| 7,654,705 | B2 | 2/2010 | Czech et al. | |
| 7,744,246 | B2 | 6/2010 | Rizkin et al. | |
| 7,766,509 | B1 | 8/2010 | Laporte | |
| 7,780,314 | B2 | 8/2010 | Seabrook | |
| 7,806,558 | B2 | 10/2010 | Williamson | |
| 7,857,497 | B2 | 12/2010 | Koike et al. | |
| 7,959,326 | B2 | 6/2011 | Laporte | |
| 7,976,194 | B2 | 7/2011 | Wilcox et al. | |
| 7,976,199 | B2 | 7/2011 | Berns et al. | |
| 8,002,435 | B2 | 8/2011 | Laporte | |
| 8,007,131 | B2 | 8/2011 | Liu et al. | |
| 8,018,457 | B2 | 9/2011 | Peterson et al. | |
| 8,057,082 | B2 | 11/2011 | Seabrook | |
| 8,066,406 | B2 | 11/2011 | Boyer et al. | |
| 8,092,042 | B2 | 1/2012 | Wilcox | |
| 8,100,552 | B2 | 1/2012 | Spero | |
| 2002/0064049 | A1* | 5/2002 | Layne et al. | 362/404 |
| 2002/0163001 | A1 | 11/2002 | Shaddock | |
| 2002/0198978 | A1 | 12/2002 | Watkins | |
| 2003/0156410 | A1 | 8/2003 | Ter-Hovhannisian | |
| 2003/0210555 | A1 | 11/2003 | Cicero et al. | |
| 2003/0210559 | A1* | 11/2003 | Jesurun et al. | 362/572 |
| 2004/0090785 | A1* | 5/2004 | McInnis | 362/362 |
| 2005/0068765 | A1 | 3/2005 | Ertze Encinas et al. | |
| 2005/0254263 | A1* | 11/2005 | Harwood | 362/648 |
| 2006/0082989 | A1 | 4/2006 | Wang | |
| 2006/0158887 | A1 | 7/2006 | Holder et al. | |
| 2006/0181880 | A1 | 8/2006 | Gordin et al. | |
| 2006/0291218 | A1 | 12/2006 | Pazula | |
| 2007/0090362 | A1 | 4/2007 | Ahn et al. | |
| 2007/0091444 | A1 | 4/2007 | Kim et al. | |
| 2007/0097689 | A1* | 5/2007 | Barausky et al. | 362/287 |
| 2007/0201225 | A1 | 8/2007 | Holder et al. | |
| 2008/0037239 | A1 | 2/2008 | Thomas et al. | |
| 2008/0101063 | A1 | 5/2008 | Koike et al. | |
| 2008/0191236 | A1 | 8/2008 | DeGraaf et al. | |
| 2008/0192480 | A1 | 8/2008 | Rizkin et al. | |
| 2008/0273333 | A1 | 11/2008 | Berns et al. | |
| 2008/0278946 | A1* | 11/2008 | Tarter et al. | 362/247 |
| 2008/0285273 | A1* | 11/2008 | Liu et al. | 362/240 |
| 2009/0007978 | A1 | 1/2009 | Alston et al. | |
| 2009/0100702 | A1 | 4/2009 | Fair | |
| 2009/0103299 | A1 | 4/2009 | Boyer et al. | |
| 2009/0185377 | A1* | 7/2009 | Johnson | 362/259 |
| 2009/0284966 | A1 | 11/2009 | Crookham et al. | |
| 2009/0322752 | A1 | 12/2009 | Peterson et al. | |
| 2009/0323330 | A1 | 12/2009 | Gordin et al. | |
| 2010/0002432 | A1 | 1/2010 | Romano | |
| 2010/0103668 | A1 | 4/2010 | Lueken et al. | |
| 2010/0103672 | A1 | 4/2010 | Thomas et al. | |
| 2010/0290225 | A1 | 11/2010 | Rizkin et al. | |
| 2011/0083460 | A1 | 4/2011 | Thomas et al. | |

FOREIGN PATENT DOCUMENTS

| | | | |
|---|---|---|---|
| DE | 202008004790 | U1 | 8/2008 |
| WO | WO0186198 | A1 | 11/2001 |
| WO | WO2006114726 | A2 | 11/2006 |
| WO | WO2007044472 | A2 | 4/2007 |
| WO | WO2008092271 | A1 | 8/2008 |
| WO | WO2008106843 | A1 | 9/2008 |
| WO | WO2008123960 | A1 | 10/2008 |
| WO | WO2010033545 | A2 | 3/2010 |
| WO | WO2010033545 | A3 | 3/2010 |
| WO | WO2010042186 | A2 | 4/2010 |
| WO | WO2010042186 | A3 | 4/2010 |
| WO | WO2011123142 | A1 | 10/2011 |

OTHER PUBLICATIONS

"MIRO", Anomet 2006 Brochure, 2 pages.

Benthin, Carsten et al, Interactive Headlight Simulation—A Case Study of Interactive Distributed Ray Tracing—, Computer Graphics Group, Saarland University, Technical Report TR-2002-03 (2002)(6 pages).

BetaLED, a Division of Ruud Lighting, Brochure—"uncompromisingBrilliance", www.betaLED.com/spec-sheets.aspx, 2009 (24 pages).

CN 101220928 A—SHI, Jie—English Abstract, Jul. 16, 2008.

Color Gel, http://en.wikipedia.org/wiki/color_gel, Mar. 8, 2009, pp. 74-76.

Cree, "Cree® XLamp® XP-E LEDs" Product Family Data Sheet, CLD-DS18 Rev. 12, 2008-2010, 16 pages.

Cree, "Cree® XLamp® XR-E and XR-C LED" Binning & Labeling, CLD AP12, Rev. 8, 2004-2010, 15 pages.

Cree, Brochure—"Cree XLamp XP-G LEDs—Product Family Data Sheet", CLD-DS20 Rev. 5, pp. 1-12, Copyright 2009-2011 Cree, Inc. (12 pages).

IESNA, Light & Color, IESNA ED-100.1, 2 pages, brochure, Jun. 1993.

Illuminating Engineering Society of North America (IESNA), IESNA Lighting Education, Fundamental Level, IESNA ED-100, TM-11-00, Jun., 1993, 3 pages.

Jin, Xiaogang, et al., "Analytical methods for polynomial weighted convolution surfaces with various kernels", Pergamon, Computer & Graphics 26 (2002) pp. 437-447 (11 pages).

Leadford, Kevin F. "Illuminance Calculations—The Lumen Method", IESNA ED-150.5A, 1993, 72 pages.

Lindsey, Jack, "Illumination" IESNA ED 150.5B (1993)(32 pgs).

Lumec, A Lumec White Paper—"LEDs for outdoor lighting applications" (May 2006) (11 pages).

Luminit Shaping Light As Needed, "Architectural/Even Lighting Diffusers", pp. 77-78, www.luminitco.com., at least as early as Nov. 2009.

Musco Corporation et al.,—Annex to the European Search Report on European Patent Application No. EP 09 81 5084 and Supplementary European Search Report, dated Jan. 30, 2012, (5 pages).

Musco Coporation, PCT/US2009/057090, International Search Report and Written Opinion of International Searching Authority, mailed May 10, 2010, and International Preliminary Report on Patentability dated Jan. 25, 2011.

Musco Corporation, PCT/US2010/034530, International Search Report and Written Opinion of International Searching Authority, mailed Apr. 22, 2011, (6 pages).

Paulin, Douglas, "Full Cutoff Lighting: The Benefits", IESNA LD+A/Apr. 2001, pp. 54-56.

Philips, "power light source LUXEON® Emitter", Technical Datasheet DS25, May 2007, 19 pages.

(56) References Cited

OTHER PUBLICATIONS

Philips, "Radiation Patterns", http://www.lumileds.com/technology/radiationpatterns.cfm [retrieved from Internet on Apr. 28, 2007], 1 page.
Philips, Life LED, Breathing Life, Copyright 2008 (20 pgs).
Philips, Lumileds "Thermal Design Using LUXEON® Power Light Sources", Application Brief AB05 Jun. 2006, 12 pgs.
Philips-Lumec, Brochure—"LEONIS—Landmark of a new world" (Apr. 2009), (24 pages).
Simple Guidelines for Lighting Regulations for Small Communities, Urban Neighborhood's and Subdivisions [downloaded from http://www.darksky.org/mc/page.do?sitePageID=58881 on May 16, 2008], 3 pages, copyright 2008.
Vose, Michael D., Excerpt from book entitled: "The Simple Genetic Algorithm—Foundations and Theory", The MIT Press, 1999 (139 pages).
Whitley, Darrell, "A Genetic Algorithm Tutorial" Colorado State University, Fort Collins, Colorado (date unknown) (37 pages).

* cited by examiner

METHOD, SYSTEM AND APPARATUS FOR CONTROLLING LIGHT DISTRIBUTION USING SWIVEL-MOUNT LED LIGHT SOURCES

CROSS-REFERENCE TO RELATED APPLICATIONS

This application claims priority under 35 U.S.C. §119 to provisional application Ser. Nos. 61/226,571 filed Jul. 17, 2009, and 61/320,888 filed Apr. 5, 2010, herein incorporated by reference in their entirety.

I. BACKGROUND OF THE INVENTION

Embodiments of the present invention provide for an apparatus, system, and method for creating a composite beam from individually aimable LEDs (or other individual light sources) and associated optics such as reflectors or lenses, which is well adapted for use with lighting fixtures and systems including those used to light sidewalks, walkways, parks, etc. such as those discussed in patent application Ser. No. 12/466,640 filed May 15, 2009, issued as U.S. Pat. No. 8,256,921 on Sep. 4, 2012, and which is incorporated by reference herein. Other individual light sources could include LED packages with multiple LEDs (such as ROB, ROBA, RGBW), grouped LEDs, or plural groups of LEDs.

Individual light sources may include optics with elements such as reflectors, refractive lenses, holographic diffusive lenses, and/or other elements. Each individual optic, according to embodiments of the present invention, is part of an array of optics which may be installed and aimed individually, or may be positioned and aimed as part of a lighting design plan and thus placed in a specific location relative to the fixture and/or the other light sources, the fixture itself being oriented on site according to the lighting design plan.

The arrangement of the LED light sources could be, e.g., a ring-shaped grouping, particularly such as might fit around a post or pole, or it could be an array of rows, a circular, radial, spiral pattern or another pattern or shape. The individual optics could be mounted in the fixture by a means that also provides for adjustment in one or more directions relative to the light sources so as to vary the location of the individual beam within the composite beam. Adjustment of the LED light sources could be done on site or preset by the manufacturing or assembly process; if preset, the positioning of individual optic components in the fixture could be adjusted or fine-tuned at installation or at a later time.

Unlike conventional lighting fixtures, embodiments of the present invention can provide 'granular' or 'pixilated' control of light at a high level of precision, wherein for a given application, small areas, which could be on the order of 1 square meter (more or less according to lens design, mounting height, fixture mounting angle, etc.), can have brightness somewhat controlled. This allows areas within the target area to be emphasized. For buildings, signs, or other applications where a sharply defined shape is to be illuminated, these embodiments provide greater flexibility than conventional lighting.

II. SUMMARY OF THE INVENTION

The present invention relates to an apparatus, method, and system for customizable light output from solid state light sources including but not limited to LEDs as well as possibly other light sources.

One aspect of the invention includes an apparatus which allows the light source to be adjustably mounted and fixable in a given orientation relative to at least one degree freedom of movement, if not more.

Another aspect of the invention includes an adjustably mountable light source having optics that can be selected or adjusted to change light output pattern and/or color of the light output pattern.

Another aspect of the invention includes a plurality of adjustably mountable light sources that can include adjustable light output pattern or color from any of the plurality of sources.

Another aspect of the invention comprises a method of lighting wherein a plurality of light sources are each individually adjusted, the optics are individually selected, and their positions are selected relative to a target to create highly customizable lighting relative the target.

Another aspect of the invention comprises creating a composite lighting with different light outputs from plural adjustable light sources.

Another aspect of the invention comprises utilizing highly adjustable plural light sources with other light sources that may not be highly adjustable.

III. BRIEF DESCRIPTION OF THE DRAWINGS

FIG. 1O illustrates different forms of fixtures according to aspects of the invention arrays shown in either FIG. 1E or FIG. 1F and illustrating various lighting output applications that could use adjustable light output patterns.

IV. DETAILED DESCRIPTION OF EXEMPLARY EMBODIMENTS

A. Overview

Figure 1A:
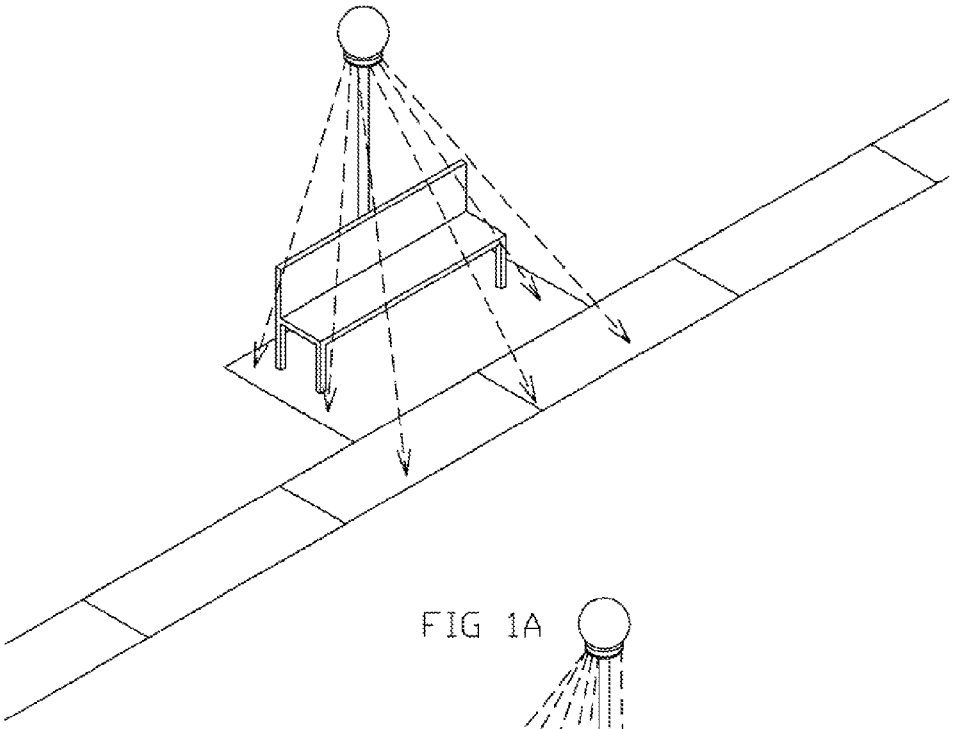
FIG. 1A is a perspective view of one exemplary embodiment of the present invention.
Figure 1B:
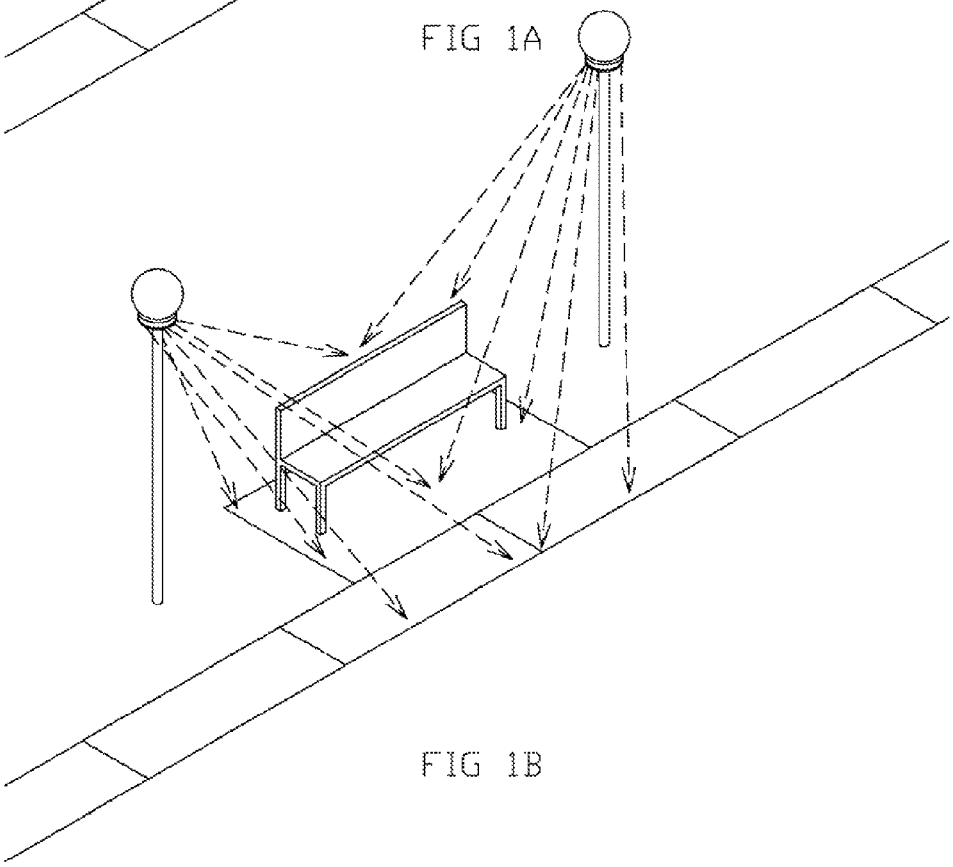
FIG. 1B is similar to FIG. 1A but an alternative embodiment of the present invention.

Embodiments of the present invention provide for an apparatus, system, and method for creating a composite beam from a plurality of individually aimable LEDs (or other individual light sources) and associated optics such as reflectors or lenses. The composite beam can be comprised of light beams from a single fixture (see FIG. 1A), or light beams from light sources of multiple fixtures that are part of a collective group (see 1B) which may be grouped together or spaced apart within or around an area to be lighted.

Figure 1C:
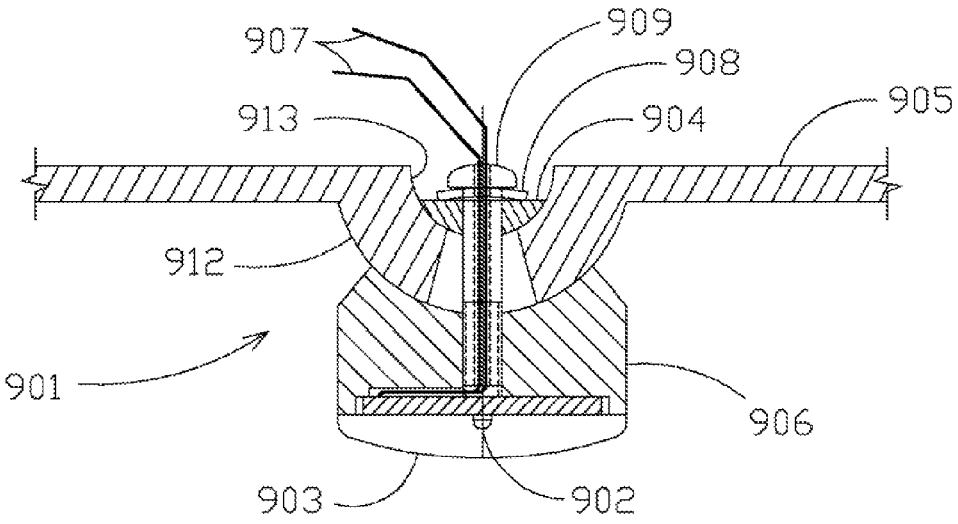
FIG. 1C is a greatly enlarged isolated sectional view of a solid state light source with adjustable mount and selective optic that could be used in the embodiments of FIGS. 1A and 1B.
Figure 1D:
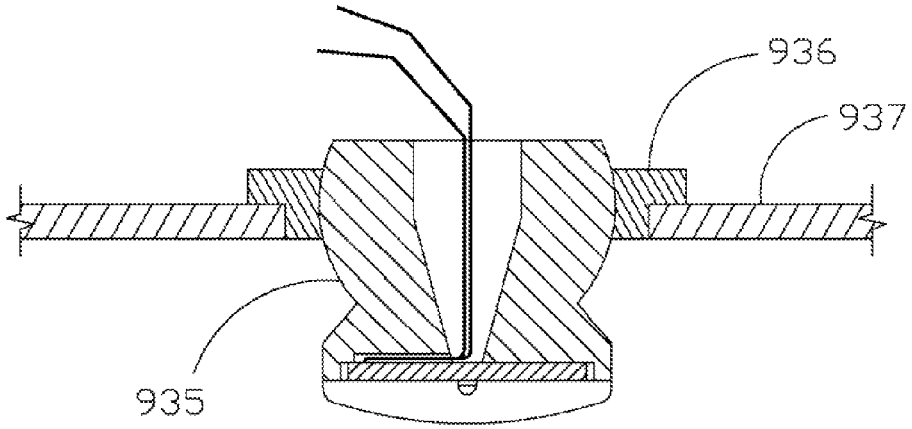
FIG. 1D is an alternative adjustable light source to that of FIG. 1C.
Figure 1E:
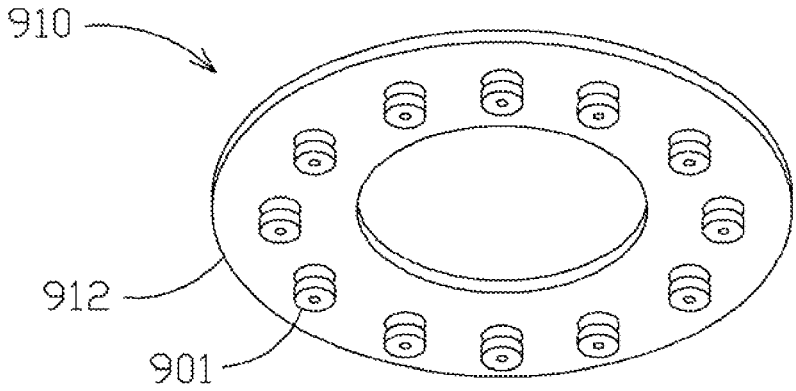
FIG. 1E is an enlarged isolated perspective view of a plurality of adjustable light sources, such as those illustrated in FIGS. 1C and 1D, mounted in a configuration that could be used in the embodiments of FIGS. 1A and 1B.
Figure 2A:
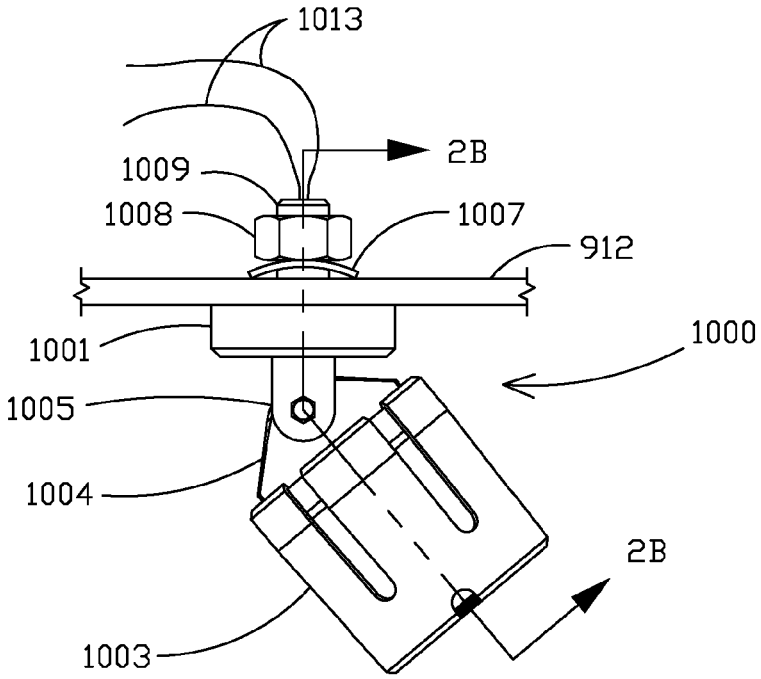
FIG. 2A is a side plan view of another exemplary embodiment of an individually adjustable light source that includes directional adjustability and at least one degree of freedom of movement, and in this case more than one degree of freedom of movement, but also a selectively interchangeable optic system.
Figure 2B:
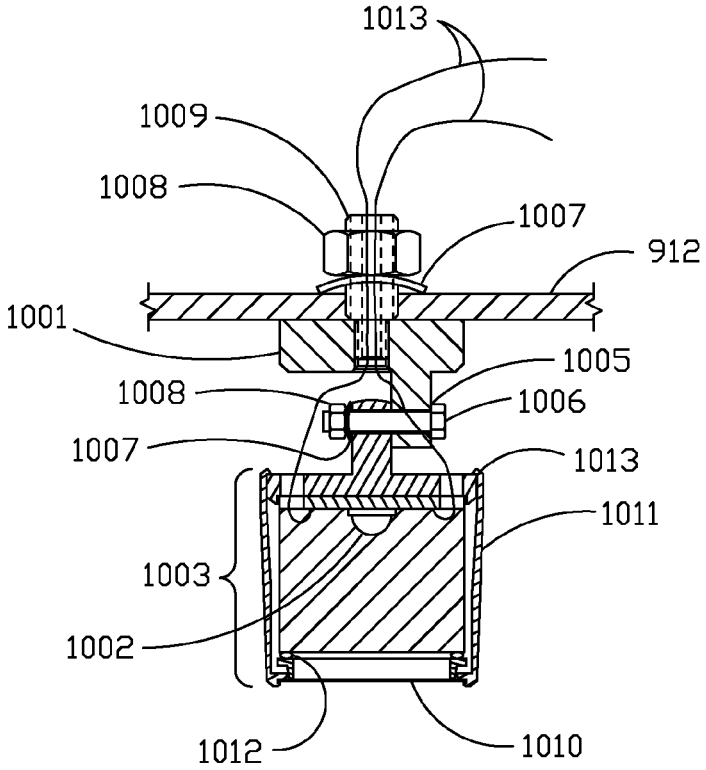
FIG. 2B is a sectional view of FIG. 2A taken along line 2B-2B.

An apparatus according to aspects of the invention comprises an adjustable light 1000, FIGS. 2A-B, which comprises an LED light source 1002 (such as a Cree XR-E LED available commercially from LED Supply, Randolph, Va., USA, or at http://www.ledsupply.com) with optional associated optics 1003 removably mounted to a mounting structure such as 912, FIG. 1E and FIGS. 2A-B. The mounting structure could also be another fixture or suitable mounting location. Light source 1000 comprises a base 1001 and a moveable light mount 1004, Light mount 1004 connects with base 1001 by means of a knuckle, oint 1005 using fastener 1006, spring washers 1007, and prevailing torque nut 1008 (other fastening methods could also be used). Base 1001 attaches to a suitable mounting structure 912 using a hollow threaded fastener 1009 (either machined as part of base 1001 or manufactured separately and installed in base). Base 1001 is secured to mounting structure 912 using prevailing torque nut 1008 and spring washer 1007. Power wires 1013 are routed through appropriate openings.

As embodied, base 1001 and light mount 1004 each have a diameter of approximately 1 inch. Light source 1000 as embodied allows approximately 45° freedom of motion of the light mount 1004 from horizontal, and 360° rotation about the base 1001. Other sizes and range(s) of movement are, of course, possible according to desire or need.

Design of the light requires that principles of thermal management well known to those in the art be practiced. The formula $T_{Junction}=T_A+(P_d)(R_{thetaJ-A})$ allows the designer to calculate power dissipation levels where $T_{Junction}$ is junction temperature of the LED, $T_A$ is power dissipated by the LED, and $R_{thetaJ-A}$ is thermal resistance between the LED junction and ambient air. Also, modifying the knuckle joint by reducing or increasing contact area will change the thermal resistance of the joint. Heat transfer paste may be used. Further information may be found in the publication from Philips Lumileds Lighting Company, "Thermal Design Using Luxeon® Power Light Sources", Application Brief AB05, San Jose, Calif., Philips Lumileds Lighting Company, 2006, pp. 1-12 available at www.philipslumileds.com/pdfs/AB05.*pdf*, which is incorporated by reference herein.

Base 1001 and a moveable light mount 1004 are machined aluminum but could be of, e.g., copper for purposes of high heat transfer capability, or of other materials such as plastic, zinc or white metal die casting, etc., particularly if alternate methods of heat transfer are selected, depending on thermal transfer needs of the LED.

Optics 1003, based on principles as discussed herein, may optionally be mounted relative to light source 1002. For example, lens 1010 is mounted on LED mount 1004 to modify or direct light from LED source 1002. Housing 1011 holds cushioning O-ring 1012 against lens 1010 which is positioned on the LED mount 1004. Tabs 1013 on the housing snap around mount 1004 thereby firmly but removably affixing lens 1010 to mount 1004.

Another apparatus according to aspects of the invention comprises an adjustable light source 901, FIG. 1C, which comprises an LED light source 902 with optional associated optics 903 removably mounted to socket 906. Socket 906 mates with ball 912 which is manufactured as part of a frame 905. Follower 904 mates with the reverse socket side (913) of ball 912. Fastener 909 captures ball socket 912/913 between socket 906 and follower 904. Spring washer 908 is held under compression between fastener 909 and follower 904. Source 902 is powered through electrical leads 907.

As embodied, ball 912 and socket 906 each have a radius of approximately 0.5 inch. Follower 904 and socket 913 each have a radius of approximately 0.25 inch. Ball-and-socket component interfaces (i.e. 906:912 and 904:913) are machined to identical dimensions using commercially available matched mill cutter sets, to a tolerance which is on the order of 0.0005 inch. Spring 908 provides a tension of between 17 and 23 pounds-force to initially hold the adjustment of the swivel joint. Screw 909 may be tightened to fully compress spring and lock adjustment in place. The ball joint as embodied allows 20° freedom of motion in any direction from the centerline. Frame 905 is on the order of 3/16 inch thick. Frame 905, ball/socket 912/913 and socket 906 are machined aluminum. Follower 904 may be aluminum or other material as it is not considered part of the thermal transfer path.

Design of the ball-and-socket requires that principles of thermal management well known to those in the art be practiced. The formula TJunction=TA+(Pd)(RthetaJ−A) allows the designer to calculate power dissipation levels where TJunction is junction temperature of the LED, TA is power dissipated by the LED, and RthetaJ−A is thermal resistance between the LED junction and ambient air. Also, modifying the ball-and-socket joint by reducing or increasing contact area will change the thermal resistance of the joint. Heat transfer paste may be used. Further information may be found in the publication from Philips Lumileds Lighting Company "Thermal Design Using Luxeon® Power Light Sources", as described above.

Ball mount could optionally be configured per FIG. 1D, having ball 935, socket 936, and base 937; or other configurations well known in the art could be selected. The ball mount could be constructed of aluminum or copper for purposes of high heat transfer capability, or of other materials such as plastic, zinc or white metal die casting, etc., particularly if alternate methods of heat transfer are selected as illustrated in FIGS. 1M and 1N. Using the ball joint for heat transfer will require careful attention to provide adequate thermal transfer and relatively high tension. The ball mount could incorporate a mechanism that allows adjustment to be secured, such as a spring tensioning device which can be captured by tightening a nut. Many other methods could be used as well.

Figure 1F:
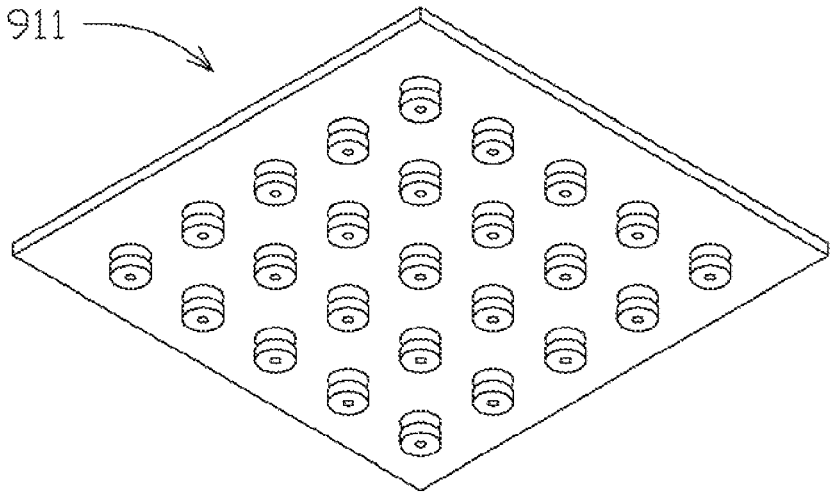
FIG. 1F is an alternative embodiment of plural adjustable light sources to that of FIG. 1E.

Another apparatus according to aspects of the invention comprises a group or array of LED light sources 901 (which may be mounted to a structure 912, directly to a fixture, etc.) such as 910, FIG. 1E, or 911 FIG. 1F. Associated optics may include refractive lenses 917, FIG. 1G, reflective lenses 916, TIR lenses 903, holographic diffusive lenses 918, filters, gels, diffusers, or other optic element types such as are known in the art. Optic elements may be adjustably mounted in proximity to the LED light source to allow focusing or otherwise modifying the associated beam. The determination of which type of associated optics elements to use can be based on applicability to a particular use, which can include considerations of type and shape of fixture for practical and aesthetic considerations.

Another apparatus according to aspects of the invention comprises one or more aimable groups or arrays of LED light sources wherein the LED light sources comprise multiple LEDs on a single mounting board. This could be embodied using RGB, RGBA, RGBW LEDs such as the OV4ZRGBA (available from OPTEK Technology Inc., www.optekinc.com). Embodiments using single-board multiple LEDs could appear and function similar to previously described embodiments, with potential advantages in brightness or ability to control color or color temperature.

Figure 1G:
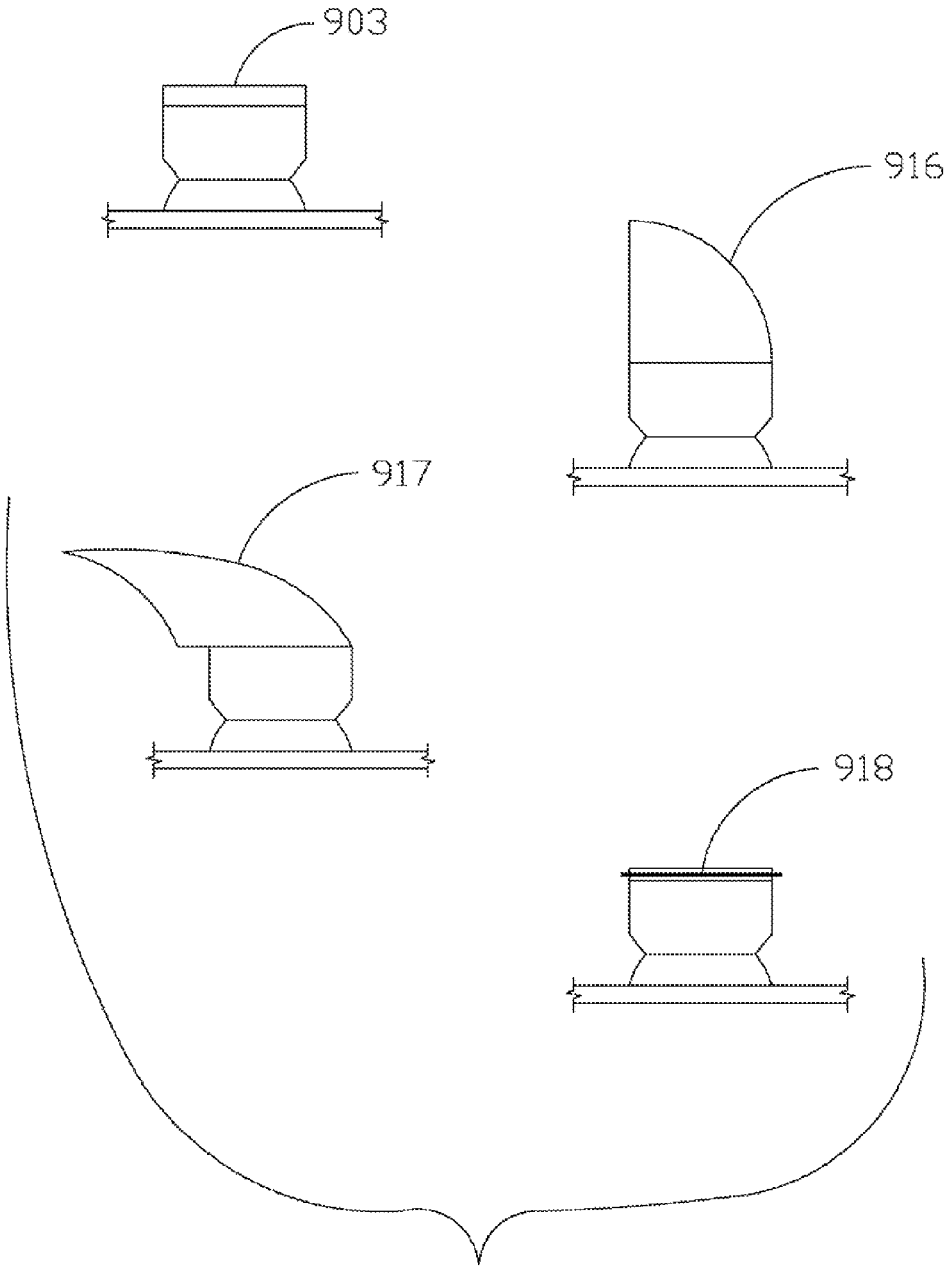
FIG. 1G are side elevation views of just a few different optics that could be selectively used with any of the individual light source members of FIGS. 1C-1F.
Figure 1H:
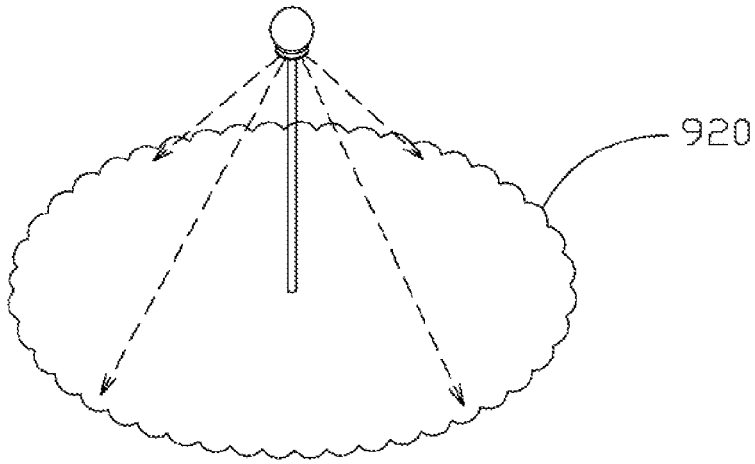
FIG. 1H illustrates the lighting fixture of FIG. 1A adjusted to produce a different light output distribution and pattern.
Figure 1I:
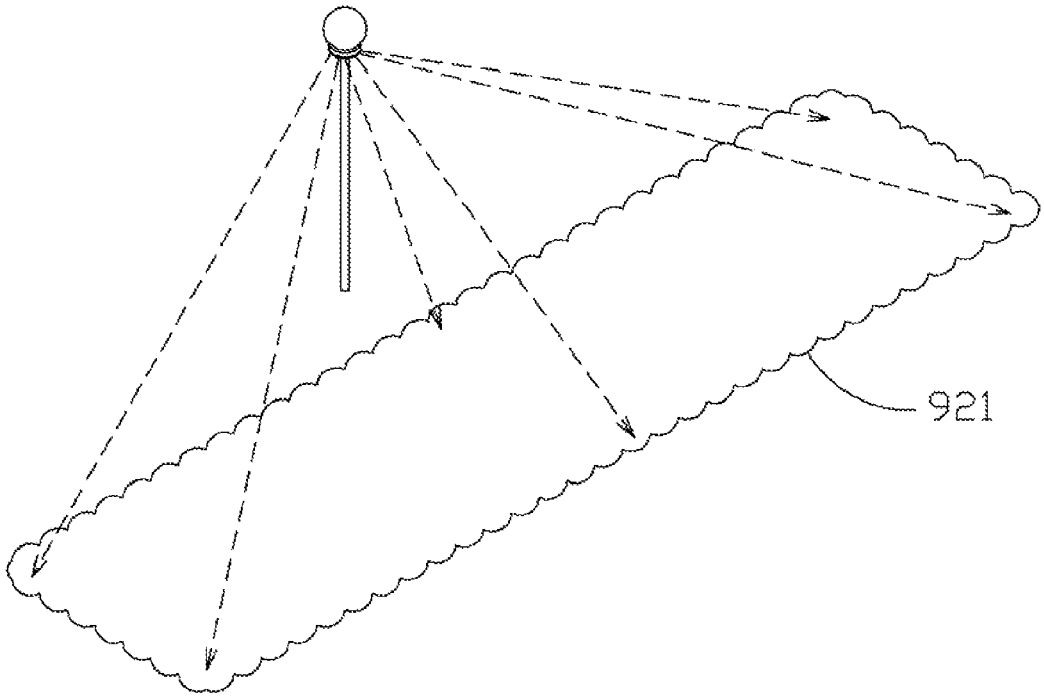
FIG. 1I is similar to FIG. 1H but shows the lighting fixture adjusted to produce a still further and different light output pattern.
Figure 1J:
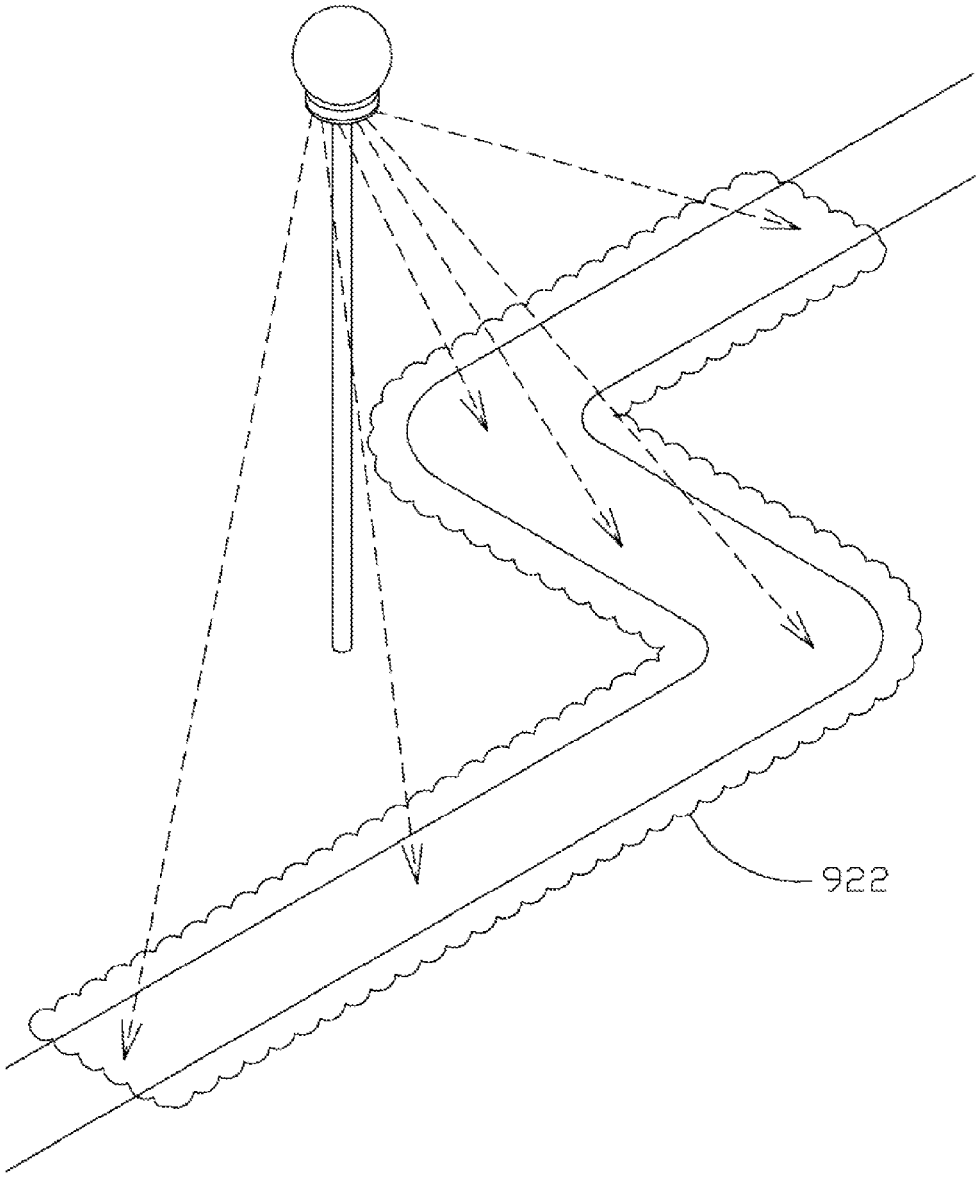
FIG. 1J is similar to FIGS. 1H and 1I but illustrates the lighting fixture producing a still further and different light output pattern.
Figure 1K:
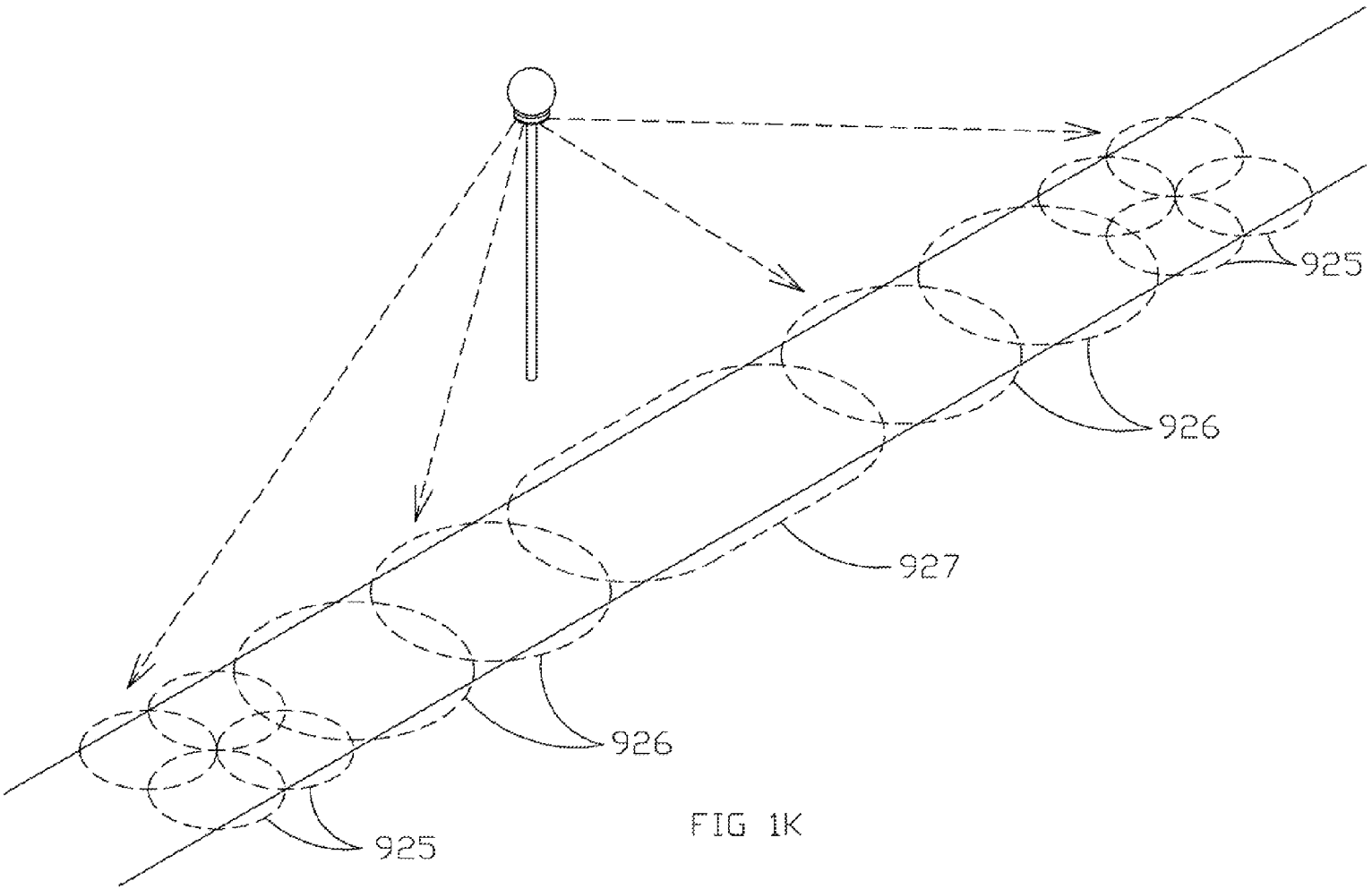
FIG. 1K is similar to FIGS. 1H-J but shows each sub-pattern from each light source.
Figure 1L:
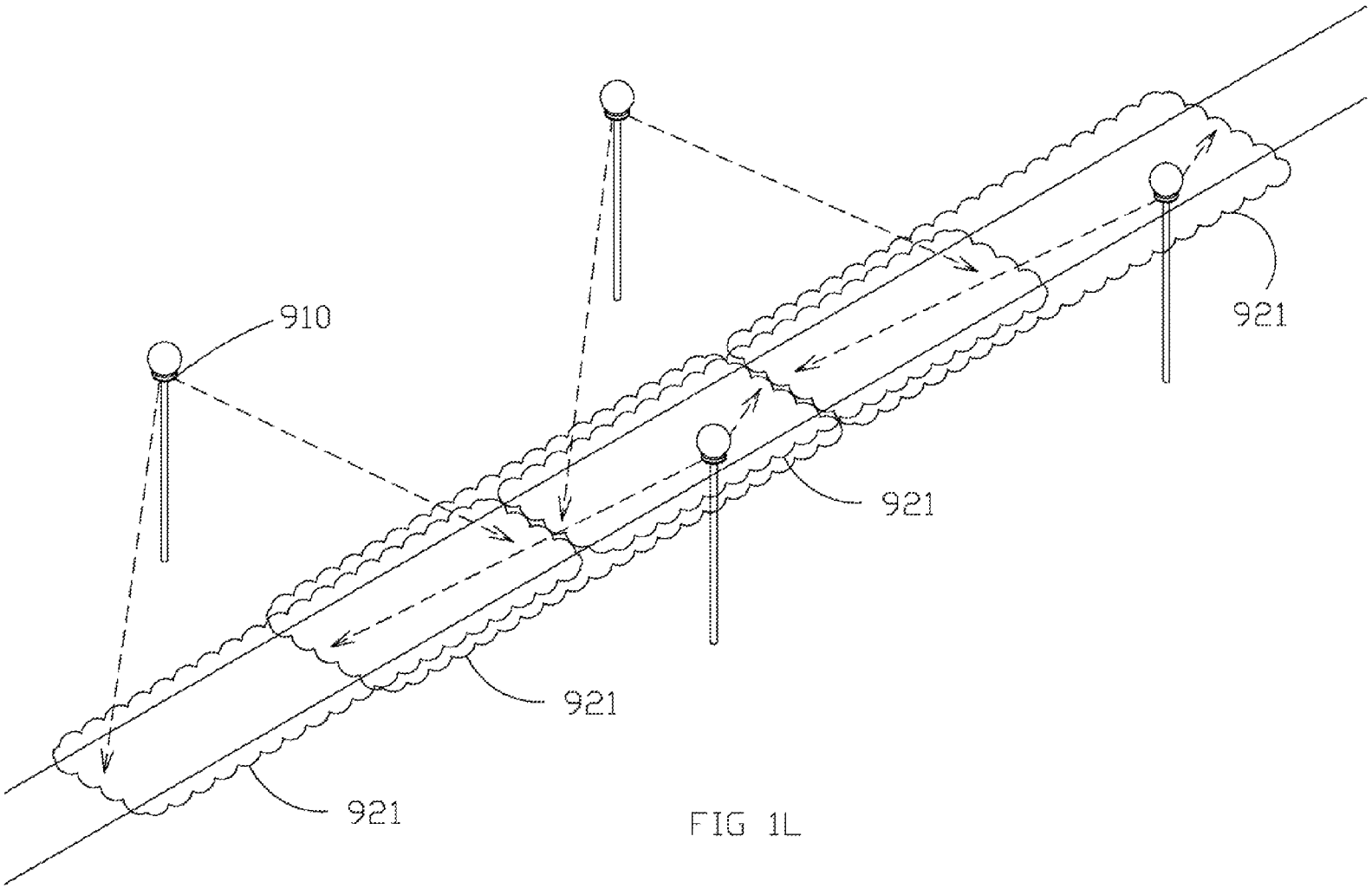
FIG. 1L shows multiple light fixtures each having the plural adjustable individual light sources adjusted to produce a composite lighting output according to another embodiment of the present invention.
Figure 1M:
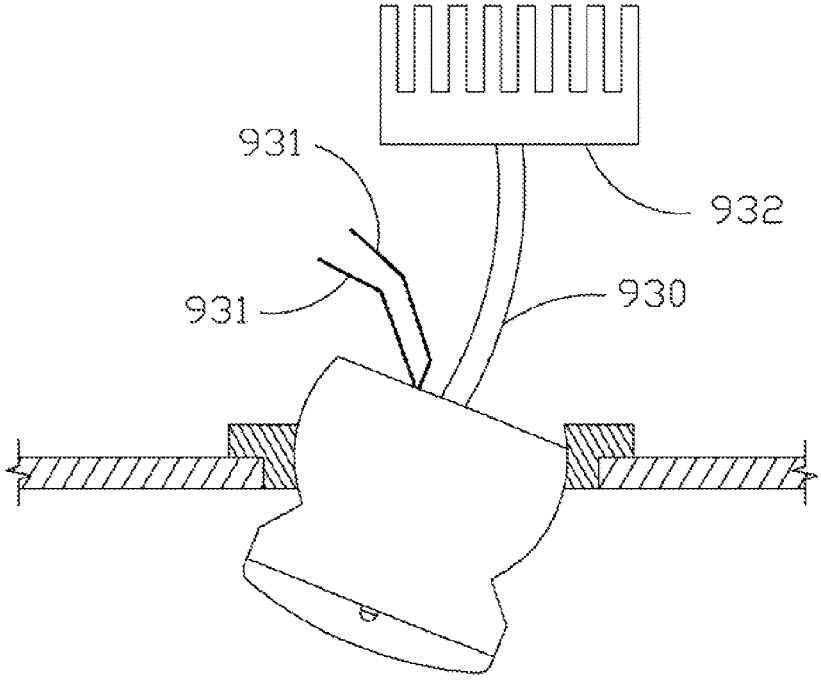
FIG. 1M is similar to FIG. 1D but shows the adjustable individual light source connected to heat management components.
Figure 1N:
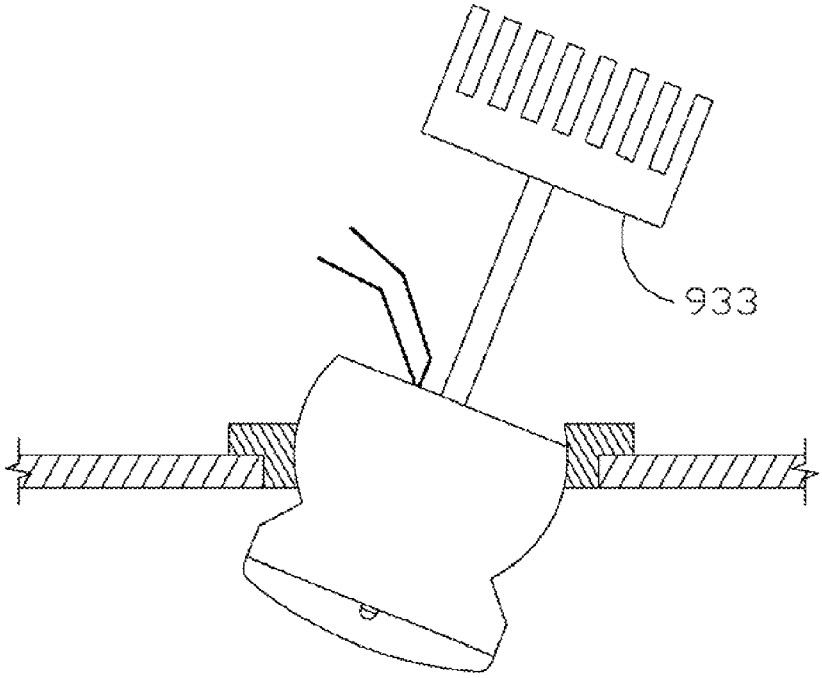
FIG. 1N is an alternative to that of FIG. 1M.
Figure 10:
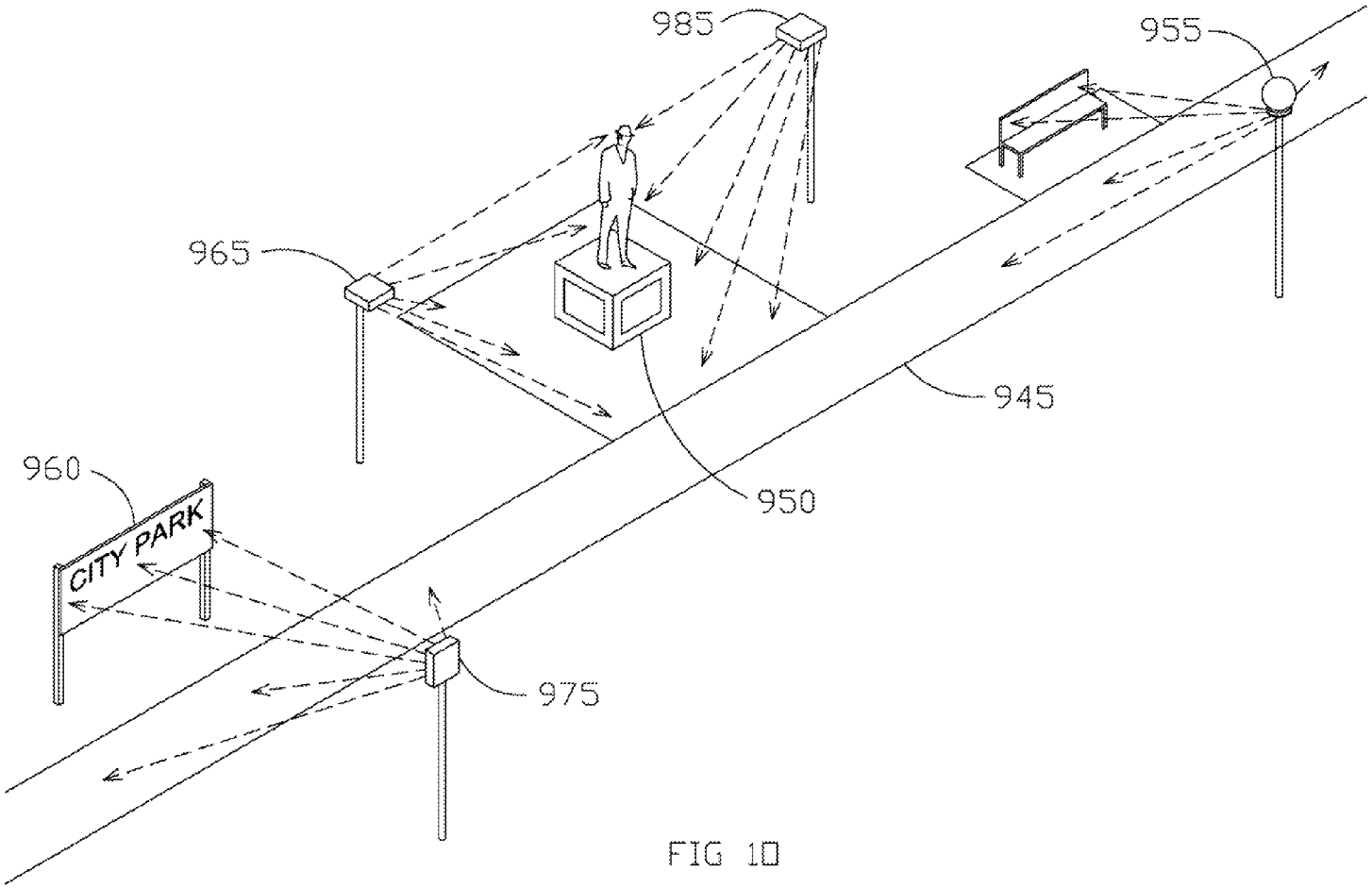
Figure 1P:
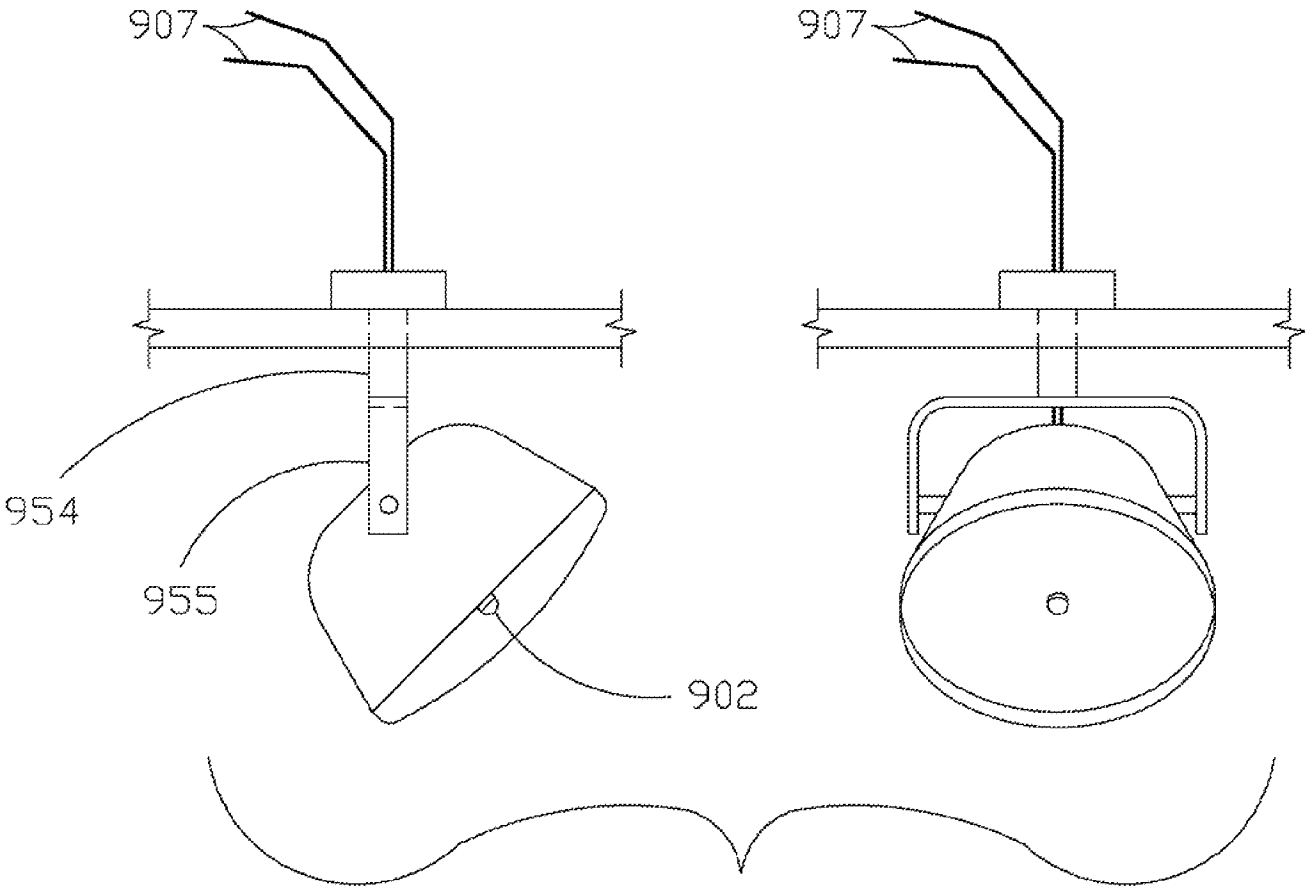
FIG. 1P shows different sides of an alternative embodiment of an adjustable individual light source as an alternative embodiment to that of FIG. 1C or 1D.
Figure 1Q:
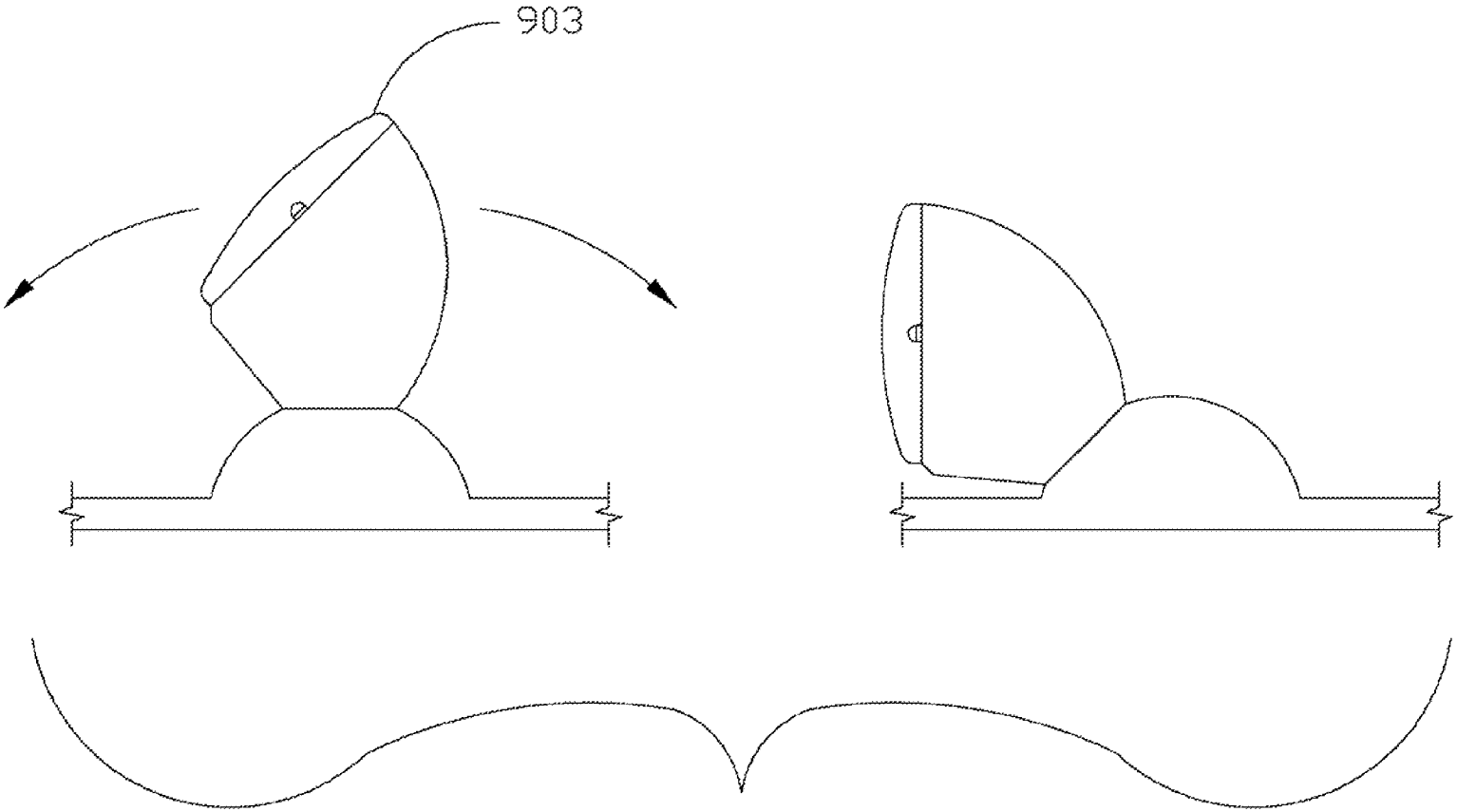
FIG. 1Q shows side views of a still further individual adjustable light source as an alternative embodiment to FIG. 1C, 1D, or 1P, the left hand view showing the member in one adjustable position, the right hand view showing it in a different adjustable position.
Figure 1R:
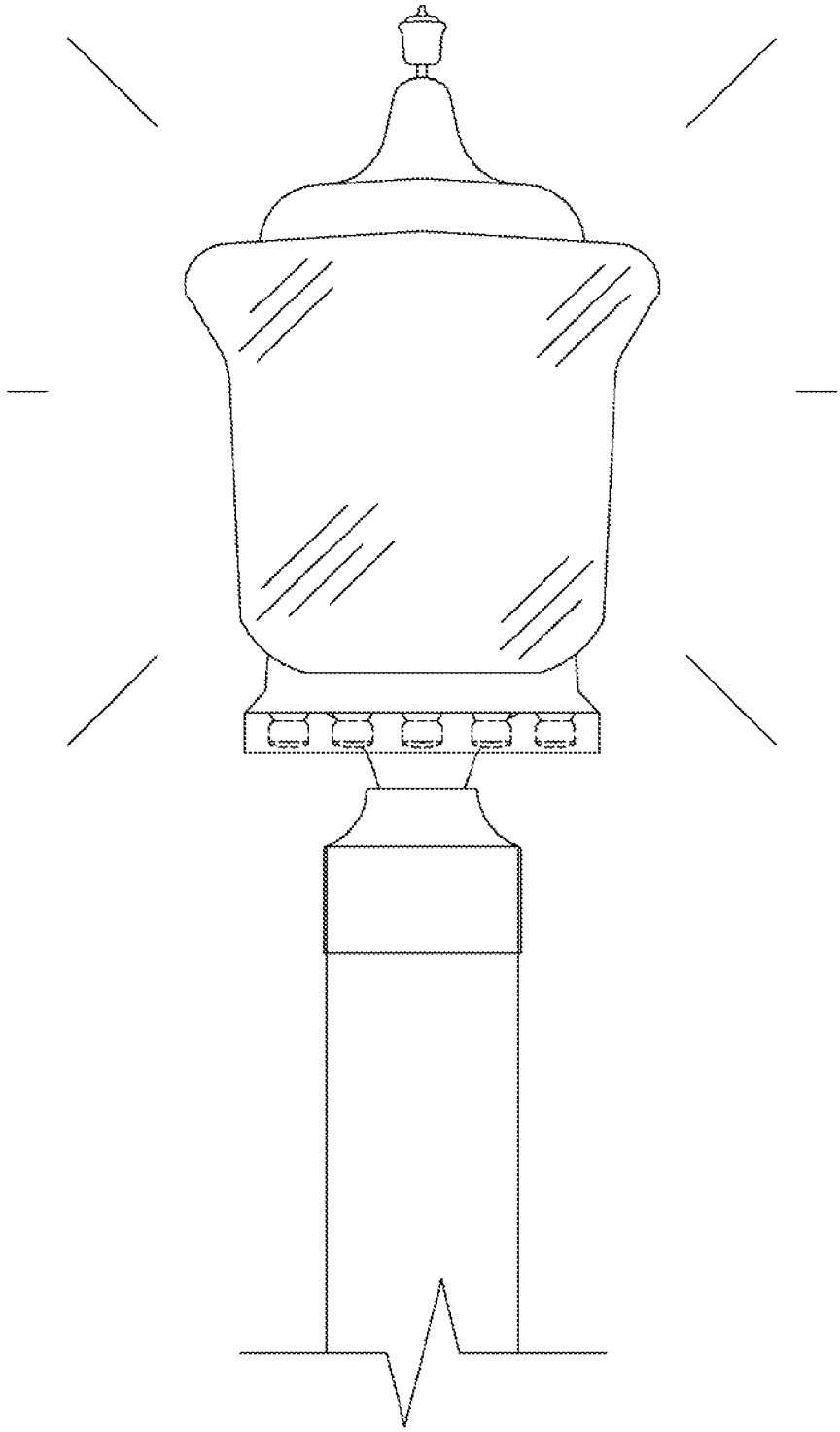
FIG. 1R is an enlarged front elevation of an alternative configuration to the fixture of FIG. 1A.
Figure 1S:
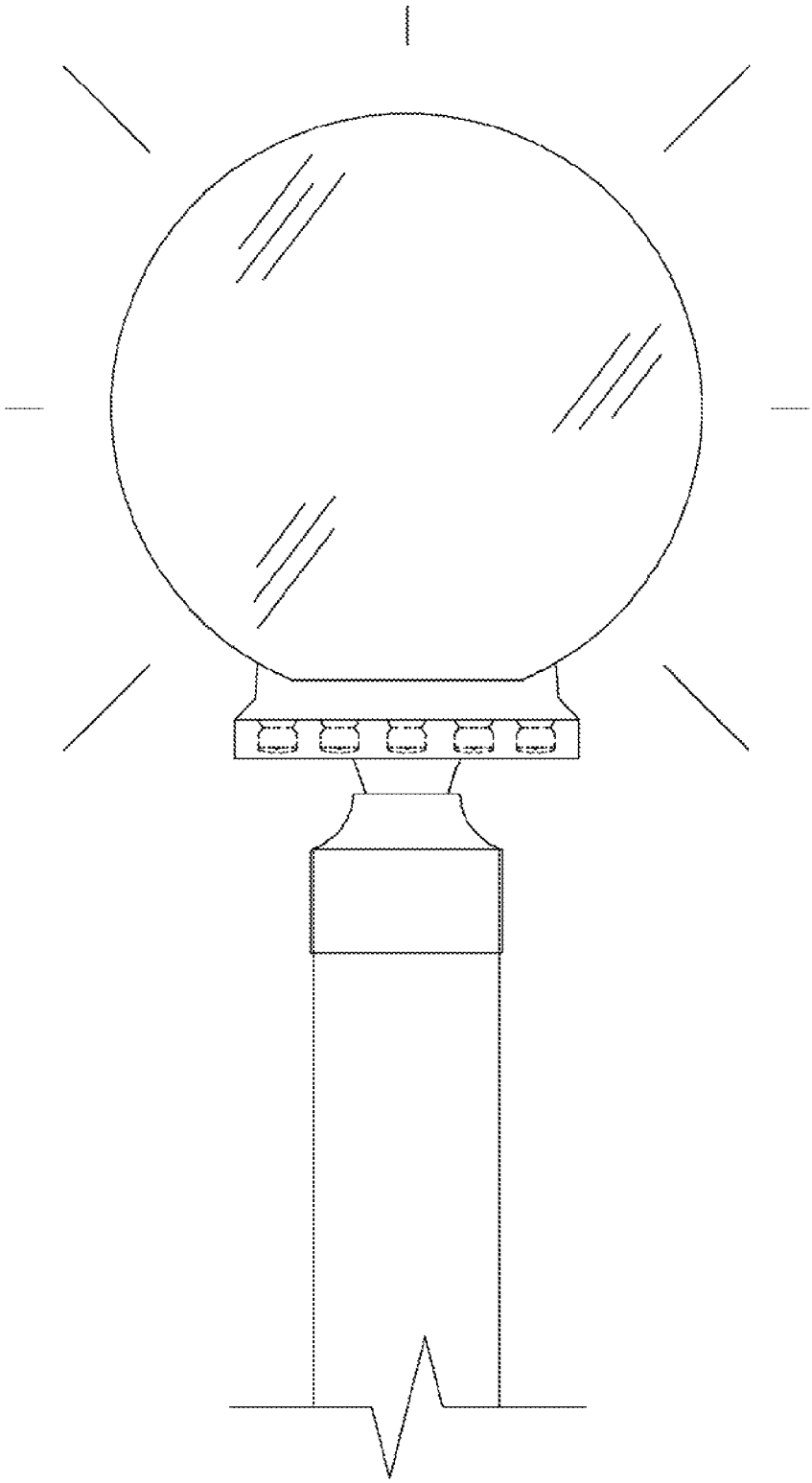
FIG. 1S is similar to FIG. 1R but shows further alternative configuration for the fixture of FIG. 1A.
Figure 1T:
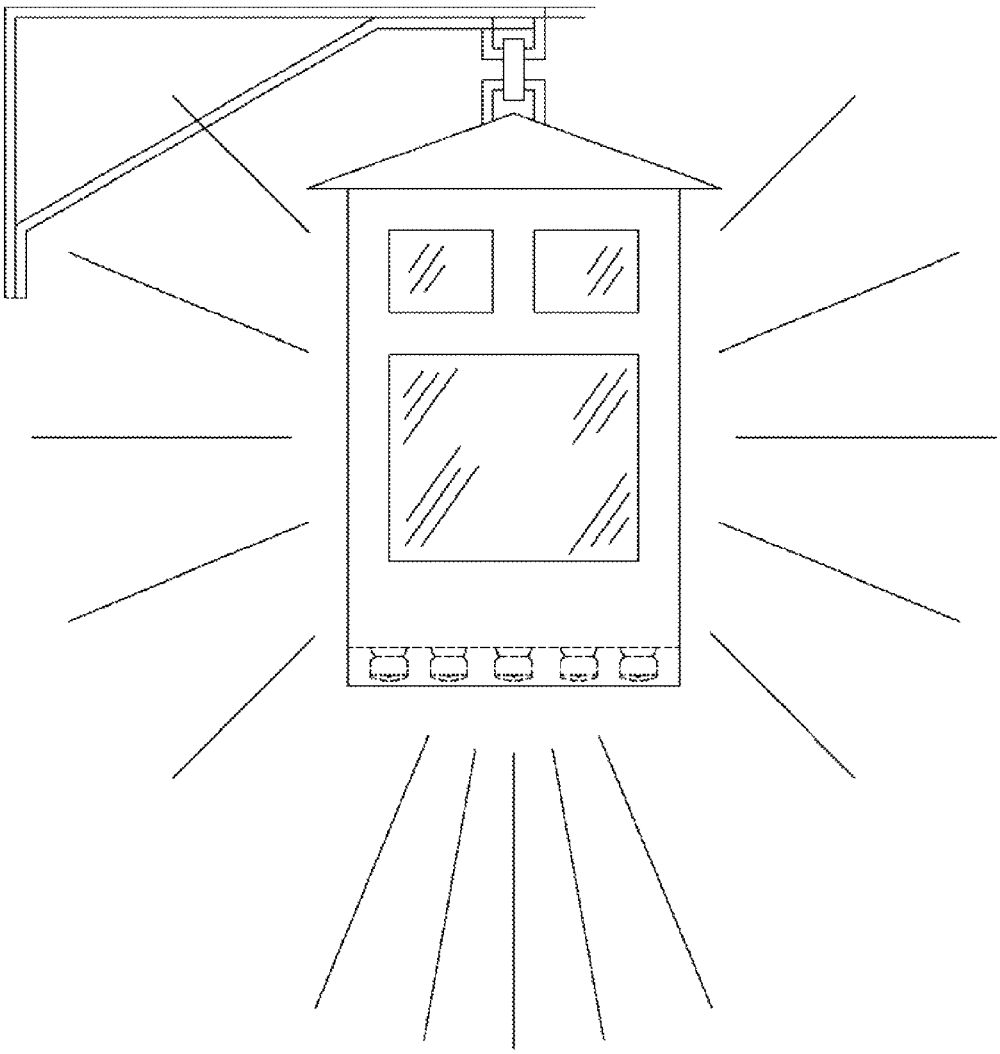
FIG. 1T shows an alternative fixture that could be hung from a vertical support.
Figure 1U:
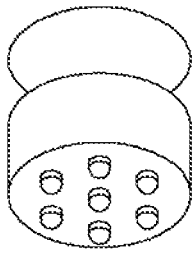
FIG. 1U is an alternative embodiment of plural adjustable individual light sources to that of FIGS. 1E and 1F, still further all mounted on a structure that itself can have adjustability relative to one or more degrees of freedom of movement.
Figure 1V:
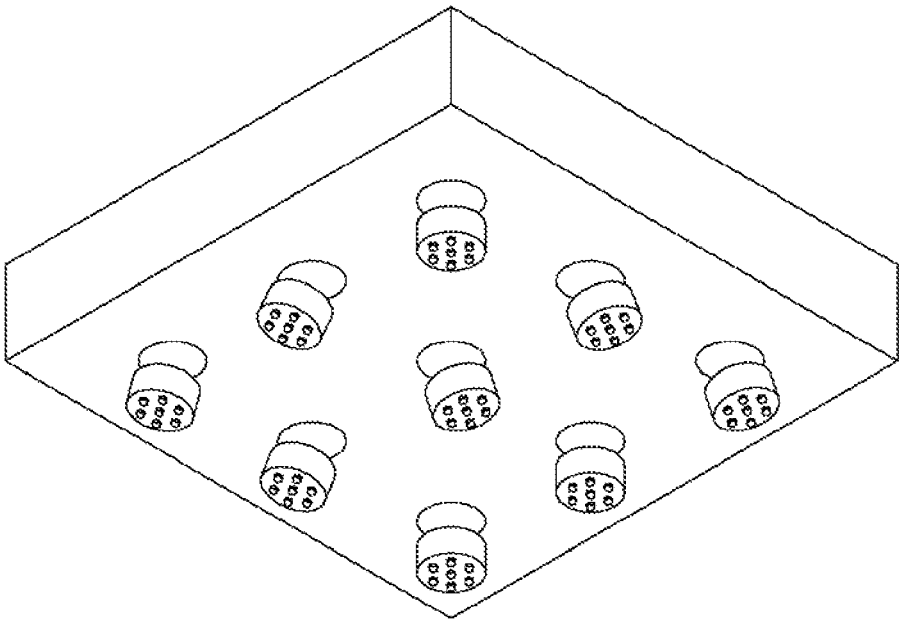
FIG. 1V is a perspective view of a plurality of the devices of FIG. 1U on a mounting support.

Another apparatus according to aspects of the invention comprises one or more aimable groups or arrays of LED light sources alone or in a fixture, FIG. 1V, wherein the LED light sources comprise multiple discrete LEDs on an aimable mount, FIG. 1U. The LEDs could optionally use common optics, individual optics per LED, or some combination thereof.

Lighting may provide a specified level of illumination based on design calculations or based on informal considerations.

B. Exemplary Method, System, and Apparatus for Designing a Composite Light Beam Embodiments of the present invention provide for an apparatus, system, and method for composing a composite light beam, such that the light beam from each optic combination (i.e. the beam produced by light from a light source which is directed by the optic) produces a portion of the overall beam pattern. This beam portion may be the primary or essentially the only light source for a certain portion of the target; alternatively, a series of overlapping beams can be built to a desired pattern by combining a set of these optics that project various beam types (for instance a circular beam type 920, FIG. 1H, elongated beam type 921 FIG. 1I, or custom shaped beam type 922 FIG. 1J).

In order to maintain the intensity within the beam pattern at a desired level of illumination, to compensate for distance (inverse square law) and incident angle (cosine law) or for other factors, multiple optics could "unevenly" contribute light to a particular region of the beam in embodiments of the present invention. For example, more individual beams 925, FIG. 1K can be directed towards the farther edges of the target area composite beam, or different beam patterns (e.g. circular 925, 926, elongated 927, narrow, wide, etc.) having different intensities can be created such that distribution in the target area is even (e.g. many 'ten degree diameter' circular beams 925 might be used for illuminating the area farthest from the fixture, while fewer 'twenty degree diameter' beams 926 could be used closer to the fixture and so on).

The beam edges may overlap the adjoining beam at any desired degree to provide uniform distribution or the entire beam may overlap another beam to increase the intensity, and the composite beam can be composed of a combination of a number of individual beams, either of similar or identical shape, or of different sizes, shapes, distribution angles, and orientations. The result would be a beam distribution, in a rectangle, oblong, oval, circle, fan, or other shape as desired. Additionally, the color temperature and desired color of illumination provided to target areas/objects will be specified.

In accordance with embodiments such as might be used in a park or pedestrian area, such a beam could provide illumination at the base of the light fixture mounting pole as well as to more a further distant areas or objects. The beam could be cut off at the edge of a pedestrian area while still providing adequate illumination close to the edge of the pedestrian area. Or, the beam could illuminate objects such as statues or artwork, FIG. 1O, in order to provide desired illumination levels, color temperatures, and colors.

C. Exemplary Method, System, and Apparatus for Designing a Lighting System

According to embodiments of the present invention, a lighting system is designed to provide a desired illumination level on a target area. The design process entails multiple steps, e.g., two or three separate steps, including analyzing the intended application, selecting individual optics, and designing the composite beam or overall lighting distribution. These steps may be repeated as necessary to optimize the design.

Analyze

Given an area to be illuminated, a determination will be made regarding the size and shape of the intended target area, along with any special areas or objects (such as e.g. statues, signs, artwork, etc.). An illumination level, color temperature, and color is selected which is appropriate to usage.

Illumination available from LED light sources is assigned by methods such as laying out isolumen contours or by dividing the total lumens required for the total area by the number of lumens available from individual light source (taking into account color, reflectivity, texture, etc. of surfaces etc. according to general principles of illumination). This will give a general idea of number and placement of fixtures.

Proposed fixture locations are established in accordance with the amount of illumination desired on given area.

These locations will then be modified, based on requirements for the target area, such as preferred, allowable, and prohibited fixture mounting locations, any required fixture setback from the target area, mounting height, calculations of angle of incidence of the illumination and consideration of the inverse square law of light.

Given these items, using one of several possible methods, the lighting designer will begin designing the light layout to provide desired illumination of the target area.

This will be similar to designing using conventional HID or LED fixtures. However, the designer can plan lighting at a much finer scale since the individual light sources each contribute a small amount to the total light applied to the entire target area.

Additionally, unlike using conventional HID or LED lighting, if there are any areas for which the amount of light should be increased or reduced, this can be accomplished by changing the aiming of a few individual light sources without necessitating a significant reduction or increase in light on adjacent areas.

Select Optic

Light unit configurations, including any optics will be selected to provide the selected beam types. Optics can include refractive, reflective, diffusing holographic, parabolic, paraboloid, or other types. Optics will be specified also according to mounting position relative to the light source such that a given optic and light source may vary as to beam angle or other parameters according to the mounting position of the lens.

If satisfactory individual optics for the given application is already in existence, one or more types may be selected to potentially meet the needs of the application which has been previously analyzed. If not available from previous design, new ones may be designed.

While embodiments of the present invention can be used for creating area lights having patterns as prescribed by the IES types, the pattern from the luminaire is not constrained to the IES types and can be used to custom configure a luminaire for a specific lighting task.

Select Fixture

Light fixtures which use a given number of LED light sources are selected in order to generally provide the calculated illumination levels based on the number of lumens per LED light source, number of light sources per fixture, and location of fixtures. Then the light levels provided by the fixtures can be calculated for the target area to refine type, number, and placement of fixtures At this point the original design considerations and selection of optics will be re-examined and changes made as necessary to fine-tune the design. This process may be repeated until a desired level of accuracy is achieved.

Manufacture

Some embodiments of the envisioned invention provide or enhance the ability to set or pre-aim a fixture at the factory relative to a particular location or application. The envisioned embodiments may be easily pre-aimed, since their placement of light on an area can be accurately established and indexed to the intended mounting positions of the fixtures. Additionally, the fixtures may be aimed precisely in the field by indexing from individually aimed lights/optics or from precision manufactured reference location on the fixture.

D. Exemplary Method—Creating Customized (Non-Standard) Beam Shapes

Customized Beam Principles

In accordance with embodiments of the present invention, both standard and customized beam shapes may be designed using well-known optical principles to project a beam of a desired shape and distribution. For example, the fixture as configured with different optics and aiming angles can provide a type 5 lateral beam distribution with long vertical distribution, or a type 2 lateral beam distribution with short vertical distribution, or any other desired beam distributions. Design and construction methods for the optical lens and reflector are well known in the art. Fixtures which are nearly parallel to the ground which are illuminating a distant target have an emittance angle that is 'flatter' relative to the fixture, for which reflective optics may be more appropriate, while fixtures which oriented more vertically relative to the ground, or which are illuminating a target that is less distant or that is directly underneath have an emittance angle that is 'steeper' relative to the fixture, for which refractive optics may be more appropriate. However, there is considerable overlap between the alternatives and therefore choice of reflective vs. refractive would be made according to the circumstances. Alternatively, for some applications, use of both reflective and refractive optics within the same fixture might be appropriate.

Design of Composite Beam

Thus custom beams may be designed to provide coverage of a given target area. Having analyzed the overall application of the light to the target area, and selected or designed the appropriate individual optics, the designer will lay out each individual optic within each fixture to design the composite beam. In order to design a specific composite beam for a given application and target area, several methods could be used which are known to those of ordinary skill in the art.

For example, a discussion of several methods can be found in Leadford, Kevin F. "Illuminance Calculations—The Lumen Method", IESNA Lighting Education Intermediate Level ED-150.5A, Illumination Engineering Society of North America, New York, 1993, pp, 5A-1-5A-40 and Lindsey, Jack L. and Serres, Anthony W. "Calculating Illuminance at a Point", IESNA Lighting Education intermediate Level ED-150.5B, Illumination Engineering Society of North America, New York, 1993, pp, 5B-1-5B-32, incorporated by reference herein.

In some embodiments, light modeling can be used to select the optic design and orientation of the individual light beams to create the composite beam from the fixture. For example, selecting one or more of the beam shapes 925, 926, 927 shown in FIG. 1K, or from other beam shapes, the lighting designer, with optional assistance from commercially available lighting software program, can produce the desired composite beam shape and intensity. The designer can determine the number and combinations of beam patterns provided by the lenses within the fixtures. For each fixture, the designer can proceed to select individual fixtures which use a certain number of reflective and/or refractive lenses. As designed the selected lenses would be assigned a position and orientation within the fixture such that light is distributed as desired on the target area. In accordance with embodiments of the present invention, special consideration can be given to edges of target areas in order to provide even lighting at the edges without excessive spill light beyond the target area.

Design of Beam by Luminaire Equivalence

Another method of designing a specific composite beam in embodiments of the present invention is calculating the "luminaire equivalence" of each individual optic combination, using existing or custom lighting design software. Using this method, each individual source is considered as a luminaire. The designer can select the optic system based on its photometric properties and place the light from each individual source onto the target area as desired. This process would be repeated until the desired composite beam shape and intensity level was achieved. In one or more embodiments, some level of automation could be added to the design software if desired.

Design of Beam by Standard Layout Tools

Another method of designing a specific composite beam in accordance with embodiments of the present invention is to use standard layout tools such as drafting board, computer-aided design software or other tool to arrange the selected beam shapes to create a composite pattern. For example, if the composite beam pattern desired looked similar to 921, FIG. 1I, then the available optics would be selected based on their distribution and intensity. These individual beams would be arranged to fill the target area. Multiple beams could be overlaid as desired to achieve the desired intensity.

Design of Beam by Other Methods

Other methods of composite beam design are possible and considered included in this application.

In addition to designing a composite beam based on the use of a single fixture, embodiments of the present invention may use multiple fixtures to target the same or overlapping areas in order to build up intensity to desired levels based on well known principals of lighting. The composite beams from two or more fixtures would be combined as in FIG. 1L to provide illumination over the entire target area.

E. Exemplary Apparatus—LED Adjustable Mount

An apparatus according to embodiments of the present invention comprises an adjustable light 1000, FIGS. 2A-B. Light 1000 comprises a moveable light mount 1004, a flexible joint such as a knuckle joint 1005, a high power LED 1002 in a compact mounting, provisions for electrical connections 1013, provisions for thermal transfer, and optional optics such as refractive, reflective, TIR or other types of lens (e.g., 903, FIGS. 1C and 1F; 916, 917, 918, FIG. 1G)

The LED can be such as Cree XR-E "star board" LED or equivalent. The flexible joint can be a knuckle joint, having a degree of flexibility of approximately 45° in any direction from its centerline. The joint can include a hollow fastener or coupling which allows power leads 1013 to be routed from the LED to a power source or driver. The flexible joint includes sufficient contact area to allow relatively large amounts of thermal energy to be dissipated to an external heat sink. Alternatively separate thermal couplings such as a separate flexible thermal coupling or heat pipe 930 such as commercially available and known in the art could join the LED source (powered through electrical leads 931) with a heat sink 932, FIG. 1M, or a heat sink 933, FIG. 1N could be attached to the LED mount which allows heat transfer on the back side of the flexible joint.

Another apparatus according to embodiments of the present invention comprises a base 906, FIG. 1C for an LED, a flexible joint such as a ball-and-socket joint 904/912/913, a high power LED 902 in a compact mounting, provisions for electrical connections, provisions for thermal transfer, and optional optics such as refractive, reflective, TIR or other types of lens (e.g., 903, FIGS. 1C and 1F; 916, 917, 918, FIG. 1G).

The LED can be such as (such as a Cree XR-E LED available commercially from LED Supply, Randolph, Va., USA, or at http://www.ledsupply.com) or equivalent. The flexible joint can be a ball-and-socket joint, having a degree of flexibility of approximately 20° in any direction from its centerline. The joint can include a hollow fastener or coupling which allows power leads 907 to be routed from the LED to a power source or driver. The flexible joint includes sufficient contact area to allow relatively large amounts of thermal energy to be dissipated to an external heat sink. Alternatively a separate flexible thermal coupling or heat pipe 930 could join the LED source with a heat sink 933, FIG. 1M, or a heat sink 932, FIG. 1N could be attached to the LED mount which allows heat transfer on the back side of the flexible joint.

Optics

Optics such as refractive lenses 917, FIG. 1G, reflective lenses 916, TIR lenses 903, or holographic diffusive lenses 918 could be placed over the LED light sources to distribute the light, creating a similar effect, i.e., a highly controlled and customizable composite beam from a light fixture(s) with a plurality of light sources. The lenses can be made of various materials depending on application, cost considerations, availability, etc. For example, the lens could be made of molded plastic, optical glass, etc.

Reflectors which could be more or less specular, diffusing, and/or absorbing, could be used. The reflector could be made of various materials depending on application, cost considerations, availability, etc. For example, a reflector could be made of molded plastic with metallized surface, injection molded, machined and polished from aluminum, etc.

Various methods of attaching the reflector to the circuit board, or other structure, are available in embodiments of the present invention. Examples of methods for attaching the reflector include, but are not limited to, mounting as individual pieces above the light sources, or using pins, fasteners or adhesive Further adjustments could be included as part of the system to allow adjustment in a plane that is not generally parallel to the fixture additionally to that provided by the ball-and-socket mount. For instance, reflectors could be adjusted by 'tipping' the reflector relative to the mounting plane, using trunnion-type mounts with e.g. setscrew or gear and sector adjustments.

Additional Features

In accordance with embodiments of the present invention, the individual optic combinations in the fixture can include a mix of different types of lenses.

The flexible mount could include various ball-and-socket designs (e.g. FIG. 1C and FIG. 1D). Additionally, other mounts that allow rotation (azimuth) and tilt could be used, such as pivoting on a pin 954, FIG. 1P for azimuth and on a trunnion 955 for tilt. The LED mount could allow a greater degree of flexibility in a certain direction to allow light to be directed more vertically, for instance, as shown in FIG. 1Q. This would greatly increase total adjustability of the fixture, since the ball joint as embodied allows 20° freedom of motion in any direction from the centerline, and since the socket/LED can be rotated on the ball, given a 20° cant of the light source on the socket, an effective adjustability of 40° could easily be achieved.

F. Exemplary Apparatus—'Acorn' Light

An embodiment in accordance with some aspects of the invention used with an 'acorn' light is illustrated in FIG. 1R.

G. Exemplary Apparatus—'Globe' Light

An embodiment in accordance with some aspects of the invention used with a 'globe' light is illustrated in FIG. 1S.

H. Exemplary Apparatus—'Lantern' Light

An embodiment in accordance with some aspects of the invention used with a 'lantern' light is illustrated in FIG. 1T.

I. An embodiment Exemplary Apparatus—Light Illuminating Statue

An embodiment in accordance with some aspects of the invention is illustrated in FIG. 1O. LED ring fixture 955 is illuminating a sidewalk 945. LED units 985 and 965 are illuminating a statue 950 and sidewalk around it. LED unit 975 is illuminating a sign 960.

J. Apparatus—Exemplary, not Limiting

The components described above are meant to exemplify some types of possibilities. In no way should the aforementioned examples limit the scope of the invention, as they are only exemplary embodiments.

In conclusion, the present invention provides novel systems, methods and arrangements for deriving composite beams from LED lighting. While detailed descriptions of one or more embodiments of the invention have been given above, various alternatives, modifications, and equivalents will be apparent to those skilled in the art without varying from the spirit of the invention. Therefore, the above description should not be taken as limiting the scope of the invention.

K. Exemplary Application of Task Lighting with Reference Lighting Source

An embodiment in accordance with some aspects of the invention provides 'task lighting' as discussed in patent application Ser. No. 12/466,640 filed May 15, 2009, issued as U.S. Pat. No. 8,256,921 on Sep. 4, 2012. FIGS. 1R ('Acorn Light'), 1S ('Globe Light'), and 1T ('Lantern') illustrate (but are not limited to) embodiments that could be as task lighting in accordance with embodiments under U.S. Pat. No. 8,256,921.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations thereof.

As can be appreciated, the present invention can take many forms and embodiments. Variations obvious to those skilled in the art are included. The specific embodiments described herein do not limit the invention which is defined solely by the appended claims.

What is claimed is:

1. A light fixture having a customizable light output and an uninterrupted thermal dissipation path comprising:

a. a thermally conductive fixture base having a convex surface and forming part of the thermal dissipation path;

a plurality of solid state light sources, each solid state light source having an aiming axis and a light output pattern and generating a thermal output when operating;

a plurality of optics, each optic associated with one or more of said solid state light sources and adapted to modify one or more of the light output patterns and aiming axes of said one or more solid state light sources;

d. a thermally conductive mounting frame forming part of the thermal dissipation path and adapted to support of or more of said solid state light sources, the mounting frame having a concave surface adapted to sit flush against the convex surface of the fixture base to provide thermal conduction at contact area forming part of the thermal dissipation path and including:

i. means for adjusting the aiming axis of the one or more solid state light sources relative to a reference while maintaining the contact area with the fixture base, wherein said means provides:

1. 360 degrees of rotation about the aiming axis; and 2. a range of aiming angles defined by the (i) convex surface of the fixture base and (ii) the concave surface of the mounting frame;

e. so that the light output pattern can be adjusted independently for the one of more light sources supported by the mounting frame without interrupting the thermal dissipation path between the light sources and the base.

2. The light fixture of claim 1 further comprising an elevating structure proximate said reference and a knuckle joint arrangement, the knuckle joint arrangement having a portion pivotally affixed to the elevating structure and a portion pivotably affixed to the fixture base such that the fixture base may be pivoted about the elevating structure relative to said reference.

3. The light fixture of claim 2 wherein the elevating structure comprises a pole or building.

4. The light fixture of claim 1 wherein the optics comprise at least one of a lens and a reflector.

5. The light fixture of claim 1 wherein each solid state light source further comprises as means for changing color comprising a color filtering member.

6. The light fixture of claim 1 wherein each solid state light source is aimed according to a lighting design plan.

7. A lighting apparatus comprising:

a. a base having a thermally conductive characteristic;

b. a mount having a thermally conductive characteristic and translatable relative to the base over a range of motion in at least one degree freedom of movement;

c. one or more individually aimable solid state light sources or other light sources mounted on the mount, wherein each light source generates a heat output during operation;

d. a heat sink associated with each of said solid state light sources, each heat sink in physical contact with each of said solid state light sources irrespective of aiming of each of said solid state light sources so to maintain a thermal dissipation path from each solid state light source to its associated heat sink irrespective of aiming, wherein the heat sink comprises the base and the mount, the base and the mount having adjacent surfaces which are in constant thermally conductive contact at a contact area over the said range of motion; and e. an associated pre-selected optic for each solid state light source or other light source wherein the preselected optic is independently aimable relative the aiming of each solid state light source or other light source.

8. The lighting apparatus of claim 7further comprising plural sets of mounts and bases, and plural sets of individually aimable solid state light sources or other light sources, each set being collectively independently aimable.

9. The apparatus of claim 7 wherein the pre-selected optics comprise one or more of:

a. one or more reflectors;

b. one or more lenses;

c. one or more light filters.

10. The lighting apparatus of claim 7 wherein adjacent surfaces of the mount and the base are complementary over the range of the motion.

11. The lighting apparatus of claim 10 wherein the adjacent surface of one of the mount and base is generally convex and the adjacent surface of the other of the mount and base is generally concave.

12. The lighting apparatus of claim 10 wherein the complimentary adjacent surfaces comprise one of:

(a) convex and concave;

(b) ball and socket; or (c) flats.

13. The lighting apparatus of claim 7 wherein size of the adjacent surfaces is correlated to the heat output of the one or more light sources.

14. The lighting apparatus of claim 13 wherein the heat sink is in thermally conductive operative communication with a further thermally conductive component.

15. The lighting apparatus of claim 13 wherein the heat sink dissipates heat.

16. The lighting apparatus of claim 7 further comprising a fixing mechanism adapted to fix the relative position of the mount and the base.

17. The lighting apparatus of claim 16 wherein the fixing mechanism comprises:

a. interference fit between the adjacent surfaces;

b. clamping action; or c. fastener.

* * * * *

UNITED STATES PATENT AND TRADEMARK OFFICE

CERTIFICATE OF CORRECTION

PATENT NO. : 8,622,569 B1
APPLICATION NO. : 12/838052
DATED : January 7, 2014
INVENTOR(S) : Joe P. Crookham et al.

It is certified that error appears in the above-identified patent and that said Letters Patent is hereby corrected as shown below:

In the Claims

Col. 11, Claim 1, Line 49:
ADD before a plurality --b.--

Col. 11, Claim 1, Line 52:
ADD before a plurality --c.--

Col. 11, Claim 1, Line 57:
DELETE after support "of"
ADD after support --one--

Col. 12, Claim 1, Line 2:
DELETE after one "of"
ADD after one --or--

Col. 12, Claim 5, Line 17:
DELETE after comprises "as"
ADD after comprises --a--

Col. 12, Claim 7, Line 41:
DELETE after the "preselected"
ADD after the --pre-selected--

Signed and Sealed this
Twenty-fifth Day of March, 2014

Michelle K. Lee

Michelle K. Lee
*Deputy Director of the United States Patent and Trademark Office*